United States Patent [19]

Duncan

[11] Patent Number: 4,860,449

[45] **Date of Patent: * Aug. 29, 1989**

[54] RAZOR BLADE ASSEMBLY

[75] Inventor: David S. Duncan, London, England

[73] Assignee: Wilkinson Sword Limited, Buckinghamshire, England

[ * ] Notice: The portion of the term of this patent subsequent to Dec. 29, 2004 has been disclaimed.

[21] Appl. No.: 457,314

[22] Filed: Jan. 11, 1983

[30] Foreign Application Priority Data

Jan. 27, 1982 [GB] United Kingdom ..... 8202274

[51] Int. Cl.[4] ..... B26B 21/00

[52] U.S. Cl. ..... 30/47; 30/50; 30/57; 30/60

[58] Field of Search ..... 30/47, 50, 57, 58, 60, 30/75, 78, 89, 90

[56] References Cited

U.S. PATENT DOCUMENTS

| | | | |
|---|---|---|---|
| 2,715,268 | 8/1955 | Randol | 30/64 |
| 3,816,914 | 6/1974 | Wordtmann | 30/47 |
| 3,871,077 | 5/1975 | Nissen et al. | 30/63 |
| 3,892,036 | 7/1975 | Perry | 30/50 X |
| 3,967,375 | 7/1976 | Hoffschmidt | 30/47 |
| 4,227,302 | 10/1980 | Torrance | 30/87 X |
| 4,715,120 | 12/1987 | McGready | 30/57 |

FOREIGN PATENT DOCUMENTS

| | | | |
|---|---|---|---|
| 80663/75 | 4/1975 | Australia . | |
| 13540/76 | 4/1976 | Australia . | |
| 53081/79 | 11/1979 | Australia . | |
| 2938987 | 8/1980 | Fed. Rep. of Germany . | |
| 1378085 | 12/1974 | United Kingdom | 30/47 X |
| 2066131 | 7/1981 | United Kingdom . | |

*Primary Examiner*—Frank T. Yost
*Assistant Examiner*—Willmon Fridie, Jr.
*Attorney, Agent, or Firm*—Finnegan, Henderson, Farabow, Garrett & Dunner

[57] ABSTRACT

A razor blade assembly, in the form of a complete razor or a shaving unit for mounting on a razor handle, has a blade platform supporting a blade and preferably a twin blade is mounted in a razor heaed frame for rolling movement between a shaving position in which the blade or each blade is correctly positioned, relative to a guardbar and a top cap 28, for shaving to a retracted position in which the blade or each blade is withdrawn from the shaving position.

7 Claims, 6 Drawing Sheets

RAZOR BLADE ASSEMBLY

BACKGROUND OF THE INVENTION

This invention relates to a razor blade assembly in the form of a razor, or a shaving unit adapted to be mounted on a razor handle to form a razor.

Such razor blade assemblies conventionally comprise a razor blade, or preferably two superimposed spaced-apart and staggered razor blades, mounted on a blade platform and supported within a frame, the frame including a guardbar which in use contacts the face of the shaver, and a top cap. When in use, the edge of the blade or of each blade should lie between and parallel to the guardbar and the forward edge of the top cap at a correct exposure for shaving, i.e. in a shaving position.

When the razor or shaving unit is to be stored away it is preferable that the blade edge or each blade be withdrawn from the shaving position, so that the razor or shaving unit cannot harm anyone handling it.

It has been proposed, in German Offenlegungsschrift No. 2938975, to provide a razor in which the blade can be caused to slide relative to the guardbar and top cap in a plane between the shaving and withdrawn positions.

It has also been proposed, in U.K. Patent Specification No. 2066131A, to achieve the effect of withdrawing the blade by causing the top cap to slide in a forward direction screening the blade edge.

The difficulty associated with mounting a razor blade for movement within a razor frame is that the positioning of the blade edge or edges relative to the guardbar and top cap is critical and extremely close tolerances must be adhered to if the shaving geometry and hence the shaving quality of the razor is to be maintained through repeated blade movements, which also means that any moving parts must be subject to very little wear.

SUMMARY OF THE INVENTION

According to the present invention there is provided a razor blade assembly comprising at least one blade mounted on a blade platform, a guardbar and a razor frame including a top cap, the blade platform having thereon a first set of guide surfaces and the razor frame having thereon a second set of guide surfaces, the second set of guide surfaces being in engagement with the first set of guide surfaces and supporting the blade and blade platform for rolling movement along a predetermined guide path between a shaving position in which the blade, guardbar and top cap are relatively positioned for shaving and a retracted position in which the or each blade is retracted from the shaving position.

In a preferred form of the invention, the guardbar is supported on the blade platform for movement therewith.

By the expression "rolling movement" as used herein in relation to the movement of the blade and blade platform relative to the razor frame is meant a movement which is arcuate about an axis which itself moves relative to the razor frame.

By means of the rolling movement achieved by the invention, a relatively small displacement of the blade edge or edges can result from a relatively large displacement of other parts of the blade assembly, thereby achieving low tolerances, where blade edge movement is concerned, and small amounts of wear between the relatively moving parts.

The invention will now be particularly described, by way of example only, with reference to the accompanying drawings in which:

DETAILED DESCRIPTION

Figure 1:
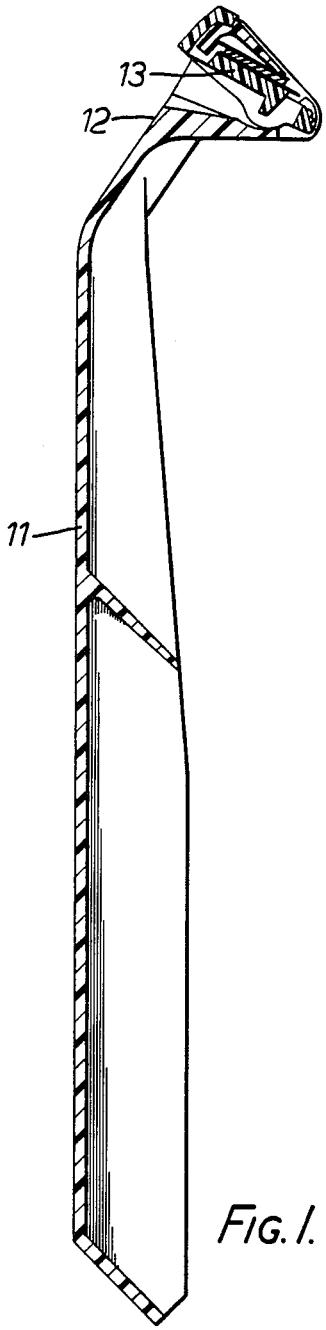
FIG. 1 is a side elevation, part sectioned, of a razor in accordance with the present invention.
Figure 2:
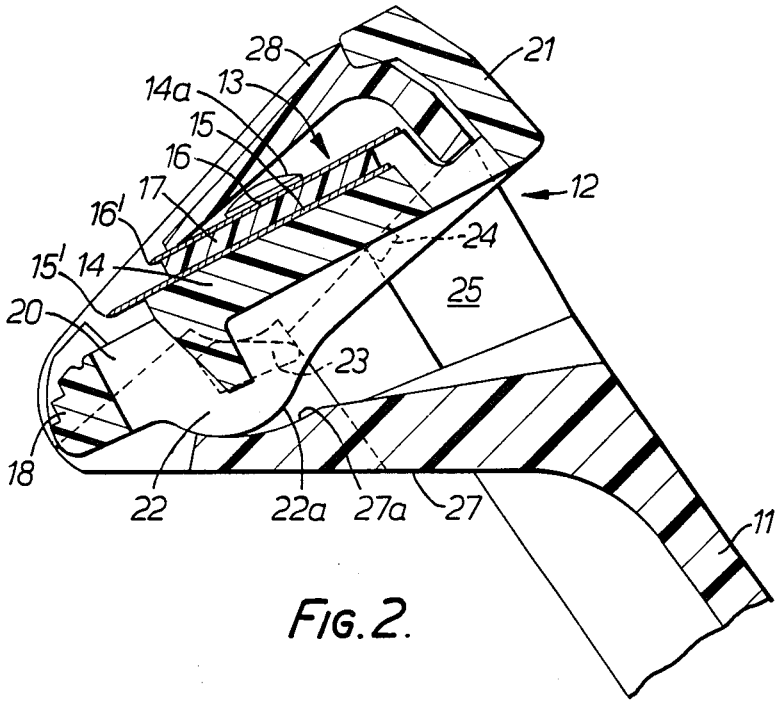
FIG. 2 is a section, on an enlarged scale, through the head of the razor of FIG. 1, showing the razor blades in a shaving position.
Figure 3:
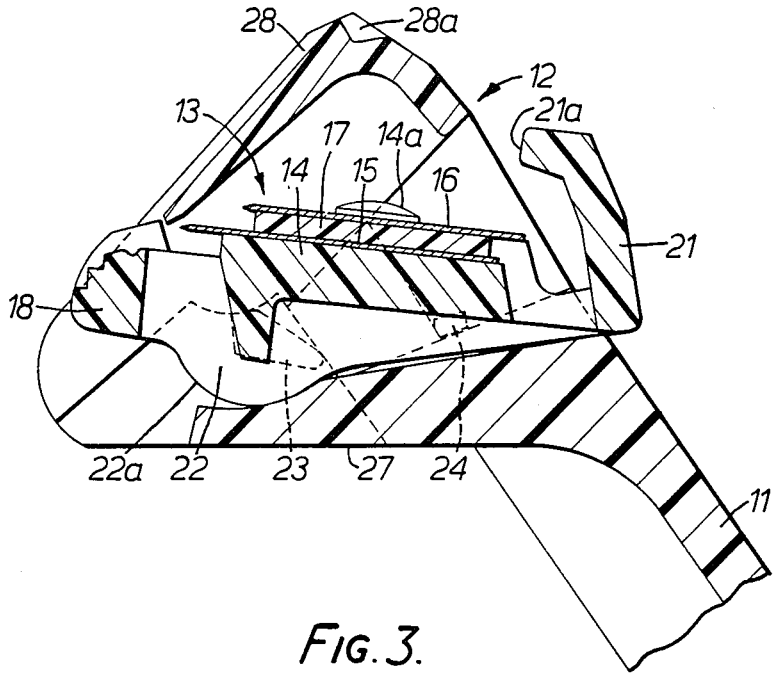
FIG. 3 corresponds to the view of FIG. 2 but shows the blades in a retracted position.

As best seen in FIGS. 1, 2 and 3, the razor, according to a first embodiment, comprises a razor handle 11 which is integral with a razor head frame 12, and a blade platform sub-assembly 13 which is mounted within the head frame 12 for movement between the shaving position of FIG. 2 and the retracted position of FIG. 3.

The blade platform sub-assembly 13 comprises a blade platform 14 on which a first blade 15 is mounted directly, and a second blade 16 is superimposed on blade 15 in staggered relationship thereto, and spaced from blade 15 by spacer 17. The blades are secured to the platform by rivets **14*a* integral with the platform 14**.

At the front of the blade platform is a guardbar 18 integral therewith but spaced therefrom by rinsing apertures 20.

Across the rear of the blade platform 14 extends an operating bar 21, formed integrally therewith, for engagement by a finger of the user to move the blade platform sub-assembly between the shaving and retracted positions.

Figure 9:
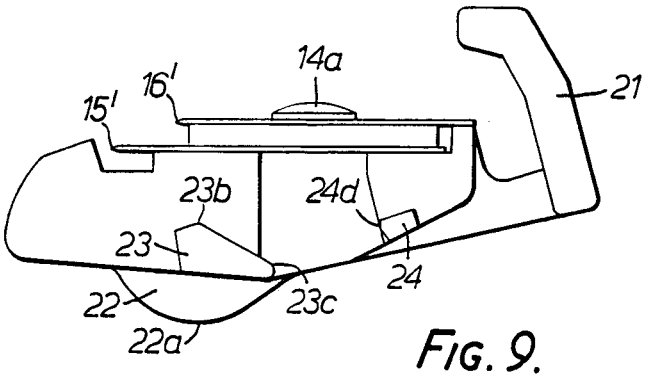
FIG. 9 is an end elevation of the blade platform subassembly.
Figure 10:
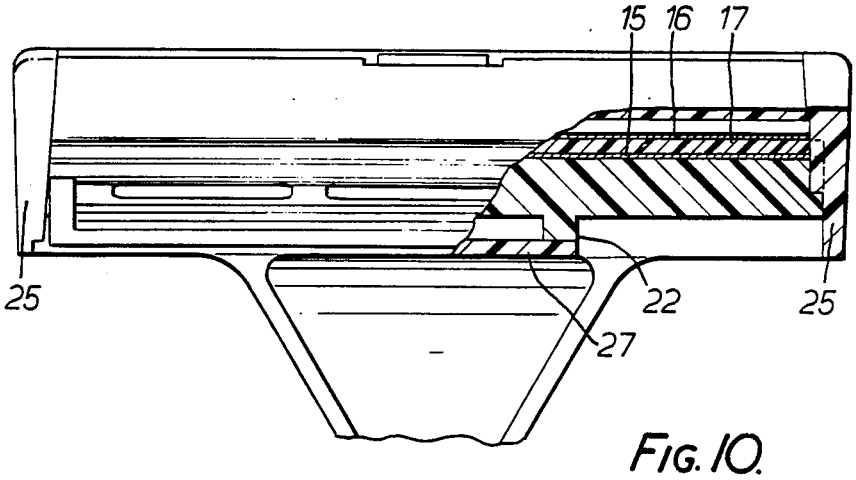
FIGS. 10 and 11 are front and rear elevations of the assembled razor with parts cut-away to show the construction.
Figure 11:
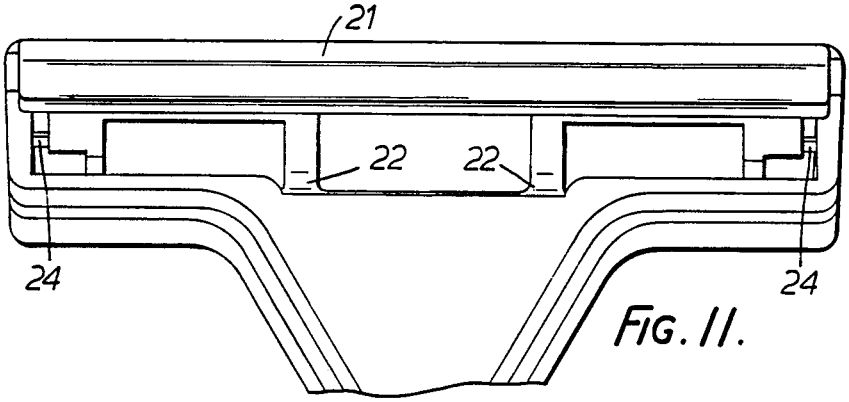

On the underside of the blade platform (see FIG. 9) are two depending lugs 22 having convex surfaces **22*a* by means of which the blade platform can roll in engagement with a concave surface of the razor frame to be described below. At each end of the blade platform are two outwardly extending lugs 23,24. The lug 23 is of generally triangular shape and has an upper convex guide surface 23*b* for sliding engagement with a convex guide surface on the frame, and a lateral convex guide surface 23*c* for sliding engagement with a substantially straight guide surface on the frame. The lug 24, which is spaced rearwardly from lug 23, has a convex guide surface 24***d* for sliding engagement with another substantially straight guide surface on the frame.

Figure 7:
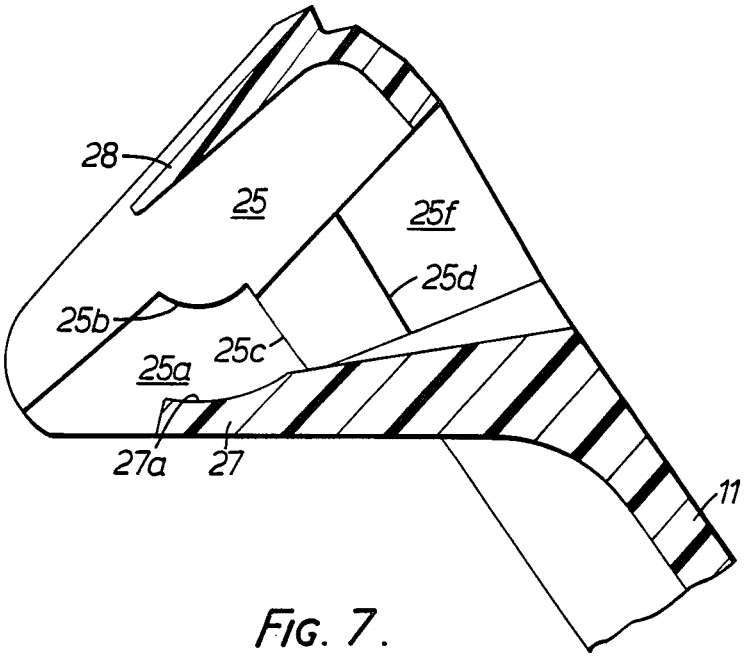
FIGS. 7 and 8 are respectively a section through the head frame of the razor and a rear elevation of the head frame with the blade platform sub-assembly removed.
Figure 8:
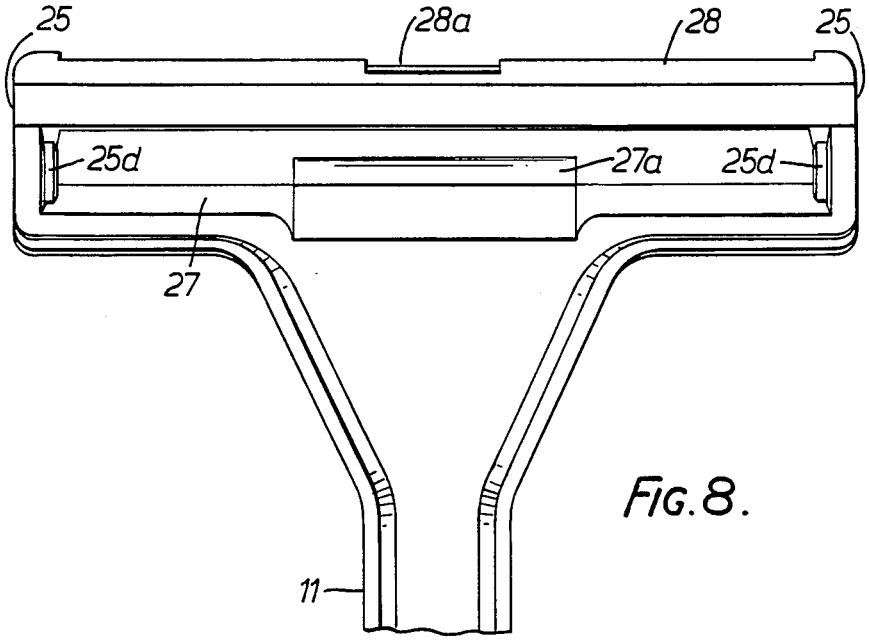

The razor frame (see FIGS. 7 and 8) comprises parallel-spaced spaced end walls 25, a lower wall 27 and a top cap 28, all formed integrally with each other and with the handle 11.

The lower wall 27 is formed with a concave surface 27*a* which is of greater radius of curvature than the convex surface 22*a* of each lug 22 of the blade platform and on which the surface 22*a* is arranged to roll in a forward and backward direction.

The inside of each of the end walls 25, is formed with a forward recess 25*a* and a rearward recess 25*f*, the inner boundary walls of these recesses forming guide surfaces 25*c*, 25*d* which are substantially straight but not quite parallel to each other for sliding engagement with the guide surfaces 23*c* and 24*d* respectively of the lugs 23,24. Surfaces 25*c*, 25*d* are preferably contoured at their opposite ends to fit tightly against the corresponding guide surfaces of lugs 23,24 and assist in positively locating the blade platform in the shaving and retracted positions respectively.

Recess 25*a* has a further boundary wall which defines a convex guide surface 25*b* which is coaxial with concave surface 27*a* and is slidingly engaged by guide surface 23*b* of lug 23.

In operation of this embodiment, if the operating bar 21 is pushed downwardly from the position of FIG. 2 to the position of FIG. 3, the lugs 22 of the blade platform will roll on concave surface 27*a* on the lower wall 27 of the frame 12, and the blade platform sub-assembly will roll backwards and downwards. This movement is guided by the sliding engagement of each movable guide surface 23*b* against fixed guide surface 25*b*, movable guide surface 23*c* against fixed guide surface 25*c*, and movable guide surface 24*d* against fixed guide surface 25*d*. Thus slippage between the rolling surfaces 22*a*, 27*a* is prevented. The two edges 15′,16′ of the blades are accordingly withdrawn from the shaving position in a rearward and downward direction.

To restore the assembly to the shaving position, the operating bar 21 is pushed upwards until a catch portion 21*a* in the centre of the bar snaps into a slot 28*a* in the centre of the rearward edge of the top cap 28. The mutually engaging surfaces of the catch portion 21*a* and slot 28*a* are inclined at such an angle as to maintain upward pressure on the bar 21 and thereby hold the blade platform sub-assembly 13 in tight contact with the underside of the front edge of the top cap 28. This tight contact assist in preventing vibration in the upper blade 16.

Figure 4:
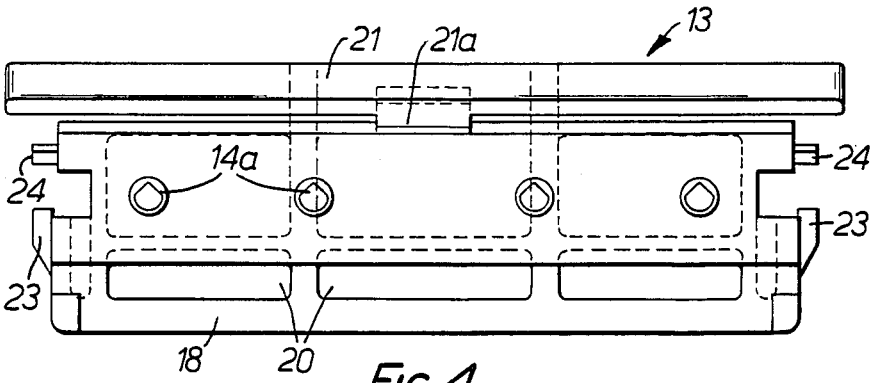
FIGS. 4, 5 and 6 are respectively a top plan view of the blade platform and a front elevation and an underneath plan view of the blade platform sub-assembly shown in FIGS. 2 and 3.
Figure 5:
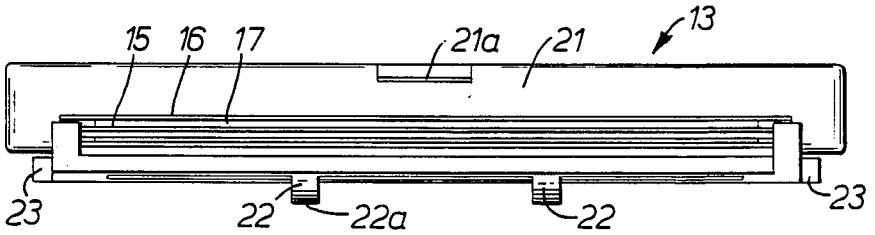
Figure 6:
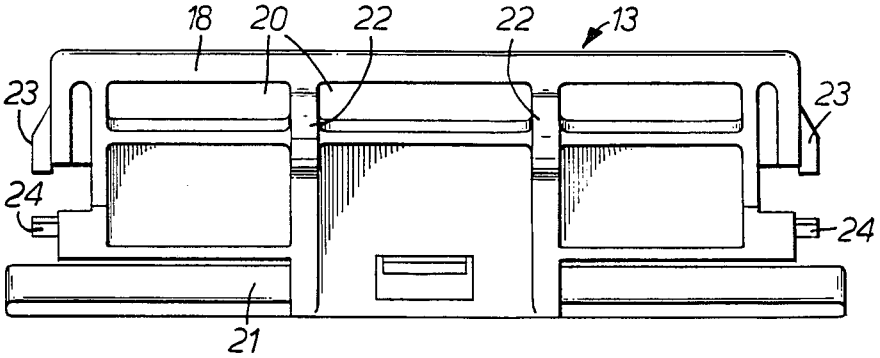

The razor is assembled by inserting the guide platform sub-assembly 13 into the frame 12 until the lugs 23 engage the guide surfaces 25*d*. The leading edges of lugs 23 are chamfered as seen in FIGS. 4 and 6 so that forward pressure applied to the sub-assembly 13 forces the end walls 25 to flex outwardly and allow the lugs 23 to slip over surfaces 25*d* into the forward recesses 25*a* of the end walls.

Figure 12:
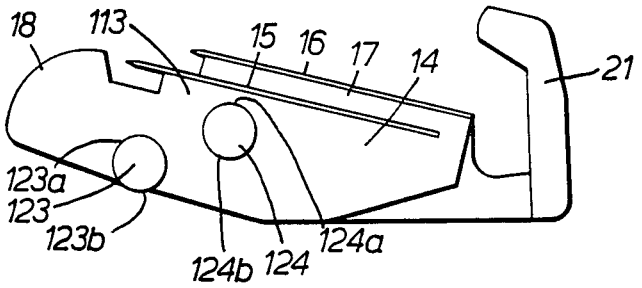
FIG. 12 is an a blade platform subassembly assembly of a modified embodiment of the razor.
Figure 13:
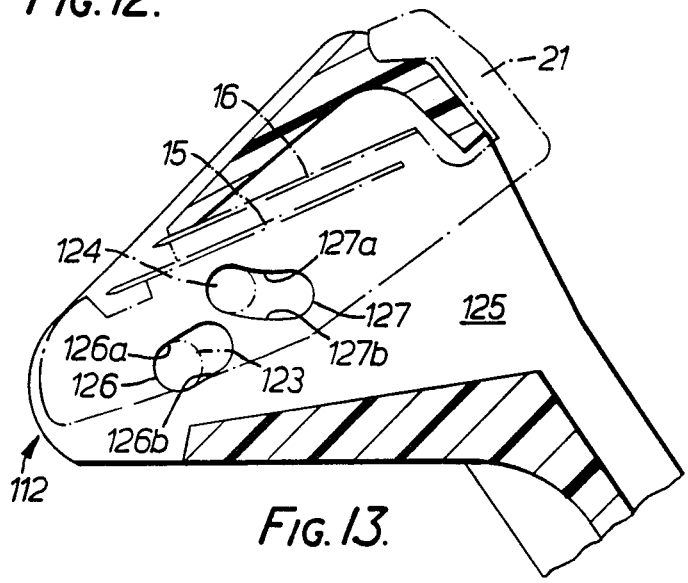
FIGS. 13 and 14 are sections through the modified embodiment showing the blade platform sub-assembly of FIG. 12 in broken line in the shaving and retracted positions respectively.
Figure 14:
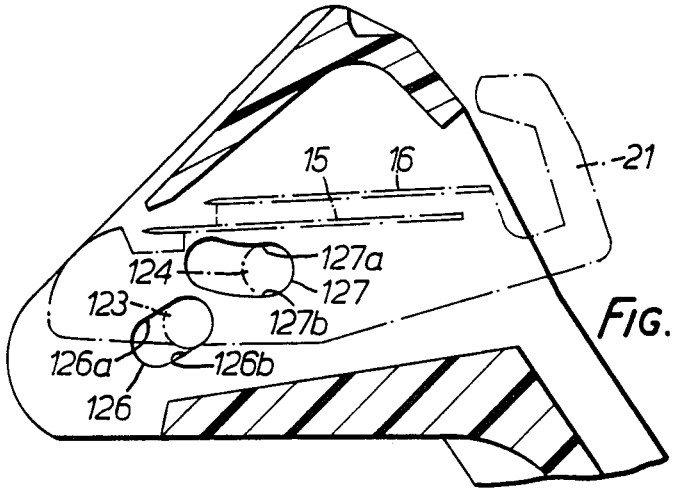

The second embodiment of the invention shown in FIGS. 12,13 and 14 is generally similar to the first embodiment and therefore like parts bear the same references. The primary difference is that the rolling surfaces are omitted and sliders, in the form of lugs 123,124 extending outwardly from the opposite ends of the blade platform 113 engage slidingly in guide slots 126,127 formed in the end walls 125. These slots can be straight or curved and can extend at selected inclinations to each other to produce any selected rolling form of movement of the blade platform sub-assembly relative to the frame.

In the second embodiment of the invention the upper and lower surfaces 123*a*, 123*b*; 124*a*, 124*b* of the lugs and the upper and lower surfaces 126*a*, 126*b*; 127*a*, 127*b* of the slots form the guide surfaces equivalent to the rolling surfaces and guide surfaces of the first embodiment.

Although in the preferred embodiments of the invention, the guardbar is fixed relative to the blade platform, as an alternative the guardbar could be fixed relative to the frame.

Again, although in each embodiment as described, lugs have been provided on the blade platform for sliding engagement against guide surfaces on the side walls of the razor frame, it will be evident that, as an alternative, suitable lugs could be provided on the side walls for engagement with guide surfaces on the blade platform.

What is claimed is:

1. A razor blade assembly comprising a blade platform, at least one blade mounted on said blade platform, a guard bar and a razor head frame including a top cap, the blade platform having thereon a first set of guide surfaces and the razor frame having thereon a second set of guide surfaces, the second set of guide surfaces being in engagement with the first set of guide surfaces and captively supporting the blade and blade platform on the frame for rolling movement of the first set of guide surfaces relative to the second set of guide surfaces along a predetermined guide path defined by said second set of guide surfaces, between a shaving position in which the blade, guide bar and top cap are relatively positioned for shaving and a retracted position in which the blade is retracted from the shaving position and underlies said top cap in proximal relation thereto.

2. A razor blade assembly according to claim 1 wherein two single-edge blades are mounted on the movable blade platform in mutually staggered fixed relationship for movement between said shaving and retracted positions.

3. A razor blade assembly according to claim 1 wherein the guardbar is fixed to the blade platform for rolling displacement therewith.

4. A razor blade assembly according to claim 1 wherein at least some of said guide surfaces are provided between each end of the blade platform and said razor head frame.

5. A razor blade assembly according to claim 1 wherein said first set of guide surfaces comprise a first movable arcuate surface which is curved about an axis parallel to the cutting edge of the blade, and second, third and fourth movable surfaces spaced from each other and from said first arcuate surface, and said second set of guide-surfaces comprise a first fixed arcuate surface of greater radius of curvature than said first movable arcuate surface and on which said first movable arcuate surface is arranged to roll, and second, third and fourth fixed surfaces spaced from each other and from said fixed arcuate surface, said second fixed surface being arcuate about the same axis of curvature as the first fixed arcuate surface and contacted by the second movable surface to maintain the first movable and fixed arcuate surfaces in mutual rolling contact and said third and fourth movable and fixed surfaces cooperating with each other to define a guide for preventing slippage between said surfaces which are in mutual rolling contact.

6. A razor blade assembly according to claim 1 wherein the sets of said guide surfaces are located between each end of the blade platform and the razor head frame and are defined by two spaced sets of slide guides, one guide of each set comprising a slider and the other guide of each set comprising an elongate slot in which the slider is received, the guides of each set being formed respectively on the adjacent faces of the blade platform and razor head frame, the two guides formed on the blade platform providing said first set of guide surfaces, and the two guides formed on the razor head frame providing said second set of guide surfaces, the slots of the guides being curved and/or mutually inclined or otherwise disposed relatively to each other to effect said rolling displacement.

7. A razor blade assembly comprising a razor head frame including a top cap, a blade platform having a guardbar integral therewith and two single-edge blades fixed to said platform in mutually-superimposed relationship, the blade platform being movable by rolling on said frame from a shaving position in which the guardbar, the blades and the top cap are correctly positioned relative to each other for shaving and a retracted position in which the blades are withdrawn from the shaving position.

* * * * *